US005868307A

United States Patent [19]

Calvert

[11] Patent Number: 5,868,307

[45] Date of Patent: Feb. 9, 1999

[54] CARTON OPENING FEATURE

[75] Inventor: Barry Gene Calvert, Covington, Va.

[73] Assignee: Westvaco Corporation, New York, N.Y.

[21] Appl. No.: 909,028

[22] Filed: Aug. 11, 1997

[51] Int. Cl.[6] ..... B65D 43/00

[52] U.S. Cl. ..... 229/125.35; 229/123.1; 229/123.2

[58] Field of Search ..... 229/123.1, 123.2, 229/125.35, 406, 407; 220/359

[56] References Cited

U.S. PATENT DOCUMENTS

| | | | |
|---|---|---|---|
| 2,381,002 | 10/1945 | Collie et al. | 229/125.35 |
| 2,973,087 | 2/1961 | Rohdin et al. . | |
| 2,990,948 | 7/1961 | Zackheim | 229/123.2 |
| 3,863,832 | 2/1975 | Gordon et al. . | |
| 3,865,302 | 2/1975 | Kane et al. . | |
| 4,183,458 | 1/1980 | Meyers et al. . | |
| 4,285,461 | 8/1981 | Meyers et al. . | |
| 4,312,451 | 1/1982 | Forbes, Jr. . | |
| 4,955,530 | 9/1990 | Rigby et al. . | |
| 5,002,223 | 3/1991 | Bolte et al. | 229/123.2 |
| 5,160,767 | 11/1992 | Genske et al. | 229/123.1 |
| 5,180,599 | 1/1993 | Feldmeier et al. . | |
| 5,244,145 | 9/1993 | Forbes, Jr. et al. . | |
| 5,433,374 | 7/1995 | Forbes, Jr. et al. . | |
| 5,516,035 | 5/1996 | Stone . | |

*Primary Examiner*—Gary E. Elkins
*Attorney, Agent, or Firm*—J. R. McDaniel; R. L. Schmalz

[57] ABSTRACT

This invention relates to carton opening features. Such structures of this type, generally, utilize a straight line sealing method and a lid having a specified corner radius, wherein the carton can be easily opened at the specified corner.

7 Claims, 4 Drawing Sheets

CARTON OPENING FEATURE

BACKGROUND OF THE INVENTION

1. Field of the Invention

This invention relates to carton opening features. Such structures of this type, generally, utilize a straight line sealing method and a lid/tray assembly having a specified corner radius wherein the carton can be easily opened at the specified corner.

2. Description of the Related Art

It is known, in the paperboard carton industry, to make use of a paperboard package which requires that the lid be constructed in a manner which allows it to be heat sealed to the tray. Exemplary of such prior art are U.S. Pat. No. 2,973,087 ('087) to H. A. Rohdin, entitled "Easy Opening Blister Pack" and U.S. Pat. No. 3,863,832 ('832) to R. L. Gordon et al., entitled "Food Container". While the lids described in these references have a pre-applied adhesive which provides for "self-venting" and "easy opening", the lid requires a separate process beyond printing to manufacture. Consequently, a more advantageous carton opening feature would be presented if the lid could be more economically manufactured and sealed to pressed paper or plastic trays without modification of straight line sealing equipment.

It is also known, to employ a tray/lid assembly that requires the lid to be sealed to the tray via a hot melt or cold adhesive. Exemplary of such prior art are U.S. Pat. No. 4,955,530 ('530) to W. R. Rigby et al., entitled "Easy Opening Lid for Ovenable Cartons" and U.S. Pat. No. 5,516,035 ('035) to J. L. Stone, entitled "Tray-Lid Assembly". While these tray/lid assemblies adequately seal the lid to the tray, the opening feature of these tray/lid assemblies requires a 100% seal around the flange of the tray to function properly. Consequently, a still further advantageous carton opening feature would be presented if the opening feature eliminated the 100% seal around the flange of the tray.

It is apparent from the above that there exists a need in the art for a tray/lid assembly which has a carton opening feature and which can be economically applied to paper or plastic trays, but which at the same time avoids the use of a 100% seal around the flange of the tray while using conventional straight line sealing methods. It is a purpose of this invention to fulfill this and other needs in the art in a manner more apparent to the skilled artisan once given the following disclosure.

SUMMARY OF THE INVENTION

Generally speaking, this invention fulfills these needs by providing a container opening feature for a container, comprising a polygonal shaped, flanged tray having first and second sides and a designated corner having a first radius and a remainder of corners of the tray have a second radius, wherein a heat sealable coating is located substantially adjacent to the first side of the tray, the flanges and the corners, and a separate lid bonded to the tray flanges by the coating to close the container, wherein the lid has first and second sides and the lid has a designated corner wherein the designated corner has an opening feature and the designated corner on the lid is located substantially over the designated corner of the tray.

In certain preferred embodiments, the lid also includes a periphery around the first side of the lid which contains partial depth cut/score lines to define a removable peripheral portion of the lid when the lid is removed from the tray. Also, the flanges have a specified corner radius. Finally, the tray is constructed of pressed paperboard or plastic.

In other further preferred embodiments, the container opening feature for a container utilizes a non-intercepting linear seal as a means to seal the carton.

A preferred container, according to this invention, offers the following advantages: ease of opening; ease of sealing; use of conventional sealing equipment; reduction of voids in the seal; excellent economy; good stability; and good durability. In fact, in many preferred embodiments, these factors of ease of opening, ease of sealing and excellent economy are optimized to an extent that is considerably higher than heretofore achieved in prior, known containers.

The above and other features of the present invention, which will become more apparent as the description proceeds, are best understood by considering the following detailed description in conjunction with the accompanying drawings, wherein like characters represent like parts throughout the several views and in which:

DETAILED DESCRIPTION OF THE INVENTION

Figure 1:
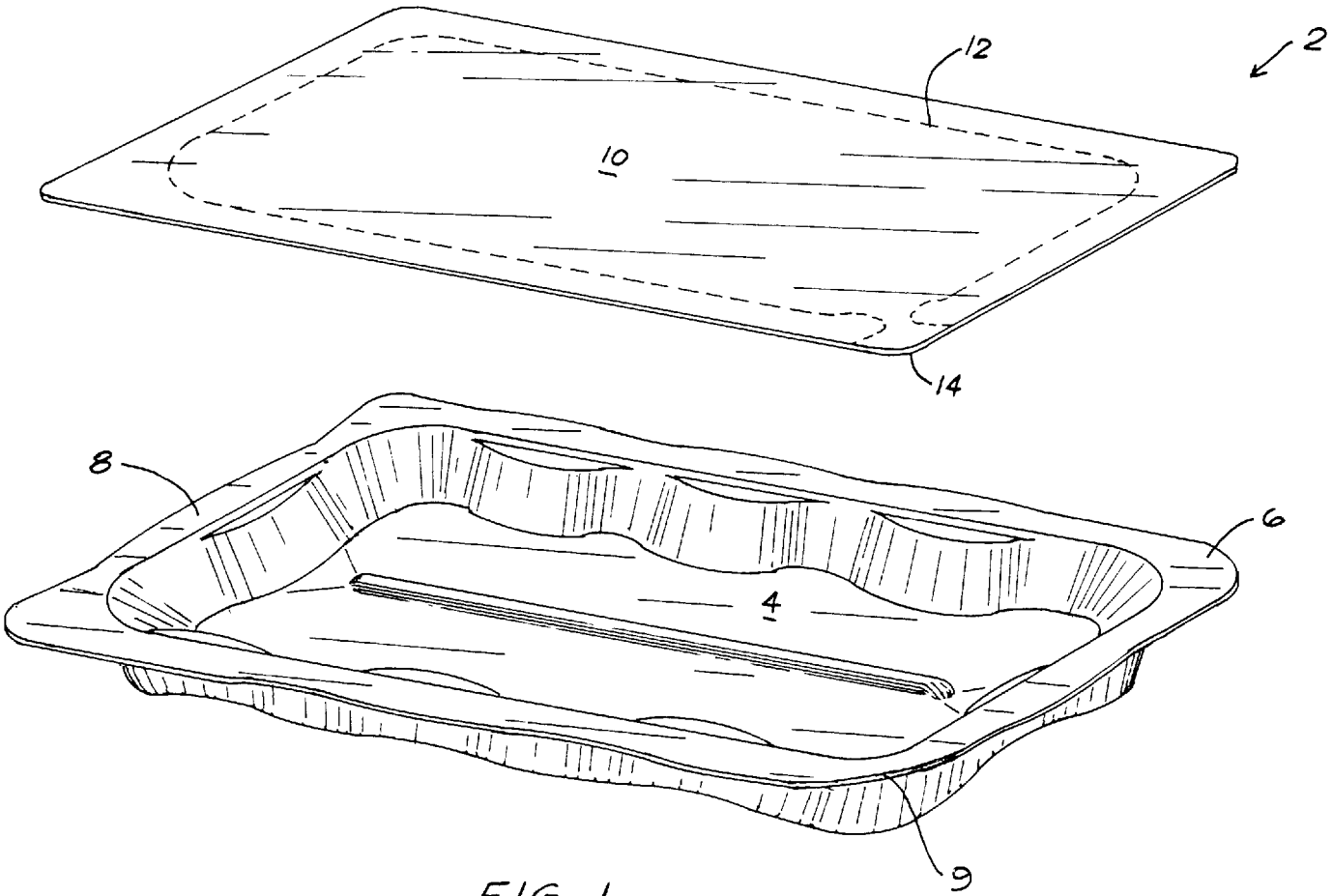
FIG. 1 is an exploded view of a container opening feature for a container, wherein the lid and tray are separated from each other, according to the present invention.

As shown in FIG. 1, container 2 includes, in part, tray 4 and lid 10. More particularly, tray 4 is produced from a paperboard substrate, typically, constructed from a 0.018 inch thick bleached sulphate sheet. Definitively, the term paperboard inches. The invention is relevant to the full scope of such a range, as applied to packaging and beyond.

When used for food carton stock for pressed trays, paperboard is usually not clay coated. Lidding for tray 4 is usually clay coated on at least one side (C1S) surface and frequently on both sides (C2S). Compositionally, the paperboard coating is a fluidized blend of minerals such as coating clay, calcium carbonate and/or titanium dioxide with starch or adhesive which is smoothly applied to the traveling web surface. Successive densification and polishing by calendaring finishes the mineral coated surface to a high degree of smoothness for a superior graphics print surface.

Pursuant to the present invention, the side of tray 4 in contact with the food is coated with a coating 8, preferably, which is a continuous polymeric coating. This polymeric coating should exhibit a relatively low softening temperature (below 400° F.) so that it may be heated and tack bonded at typical packaging line speeds with compression applied during or directly after heating to join lid 10 to tray 4. Also, polymer coating 8 must exhibit temperature stability up to 400° F. if the assembly is to be considered for ovenable applications. Finally, pressed tray 4, is also constructed with extended flanges 6. It is also to be understood that tray 4 may be constructed of any suitable polymeric material and formed by press forming or molding. Finally, tray 4 includes corner 9 which is constructed of a different radius than the other corners of tray 4.

With respect to lid 10, lid 10 includes, in part, partial depth/cut line 12 and opening feature 14. Lid 10, preferably, is constructed of paperboard. It is to be understood that the upper side of lid 10 (the side away from tray 4) is coated with a layer of a fluidized blend of materials, as discussed earlier, if a coating of print graphics is desired. The underside of lid 10 (the side facing tray 4) includes partial depth/cut score line 12 and opening 14. Partial depth/cut score line 12 is placed on lid 10 by conventional scoring/cutting techniques. Finally, it is to be understood that a polymeric material, similar to material placed on tray 4, may be continuously coated on lid 10 or applied just beyond partial depth/cut score line 12 to aid in the heat sealing of lid 10 to tray 4. Also, lid 10 may be constructed of any suitable polymeric coated material.

Figure 2:
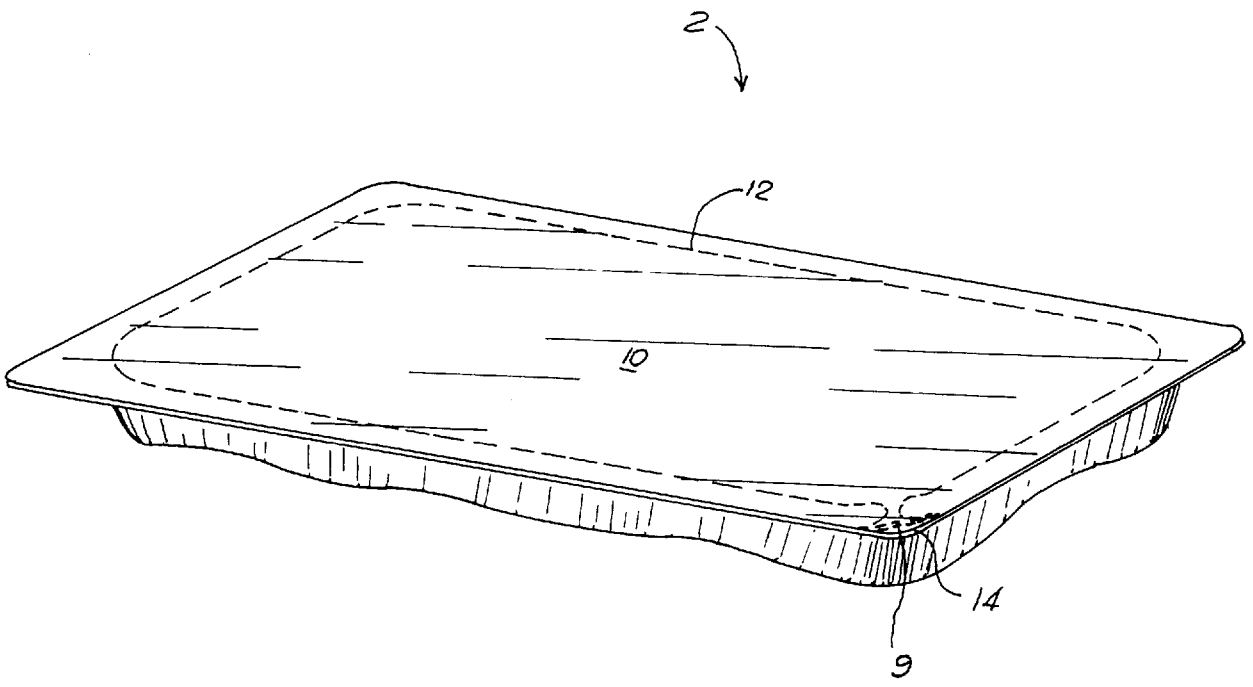
FIG. 2 is an isometric view of a container opening feature for a container, wherein the lid and tray are sealed to each other, according to the present invention.

FIG. 2 illustrates a fully constructed container 2. In this manner, lid 10 has been sealed to tray 4 through the use of a "straight line" sealing method. In particular, the heat sealing equipment heats the tray 4 and lid 10 by microwave energy or hot air, then compresses tray 4 and lid 10 together to create a fusion bond between tray 4 and lid 10 immediately after heating. Both the heating and compression is performed in a straightline/continuous motion. This linear sealing technique will be described later with respect to FIG. 4.

Figure 3:
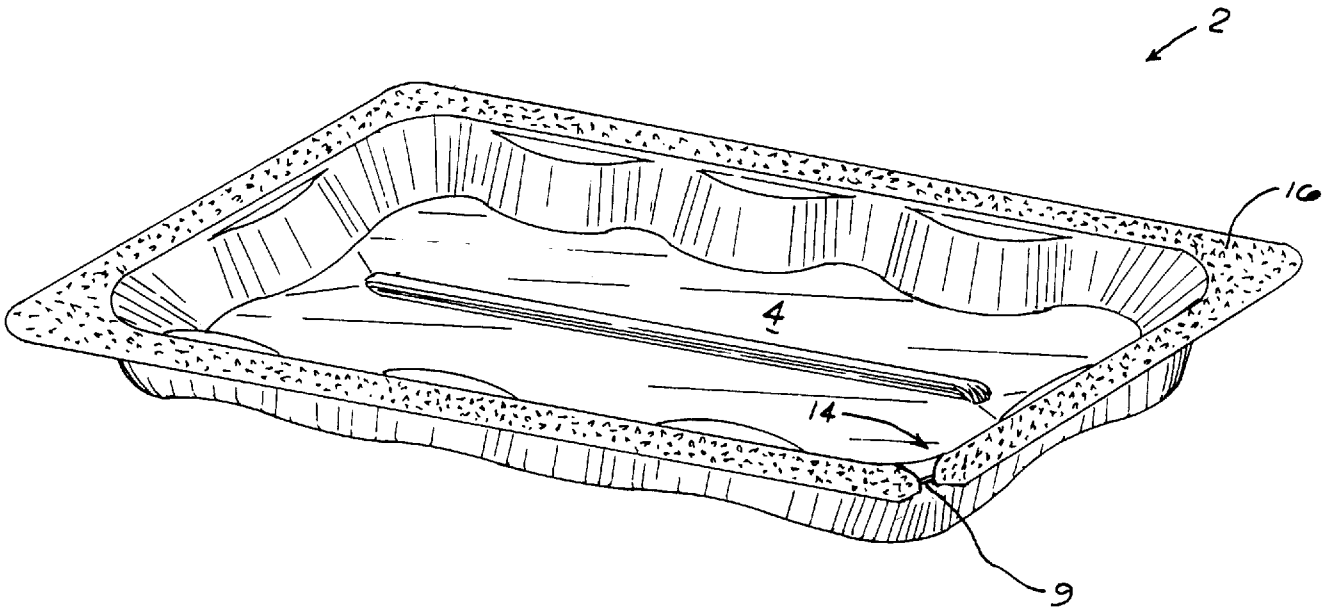
FIG. 3 is an isometric view of a container opening feature for a container, wherein the lid has been removed from the tray, according to the present invention.

Finally, as shown in FIG. 3, opening feature 14 of lid 10 extends beyond corner 9 of tray 4 so that the end-user consumer can "grab" opening feature 14 of lid 10 at corner 9 of tray 4 in order to easily remove lid 10 from tray 4. It is to be understood that the corner radius of lid 10 at opening feature 14 can be equal to or different from the radius of corner 9 of tray 4 but the corner of lid 10 at opening feature 14 must extend beyond corner 9 for proper removal of lid 10 from tray 4.

FIG. 3 illustrates carton opening feature 14 after lid 10 has been removed from tray 4. As shown in FIG. 3, after lid 10 has been removed from tray 4, a portion 16 of lid 10 remains attached to flange 6 of tray 4. Portion 16 coincides with the peripheral area located outside of partial depth/cut score line 12 on lid 10 as shown in FIGS. 1 and 2. In this manner, opening 14 allows lid 10 to be easily removed from tray 4 without damaging tray 4 or the food contents (not shown) which were previously placed into tray 4 prior to sealing of lid 10 to tray 4.

Figure 4A:
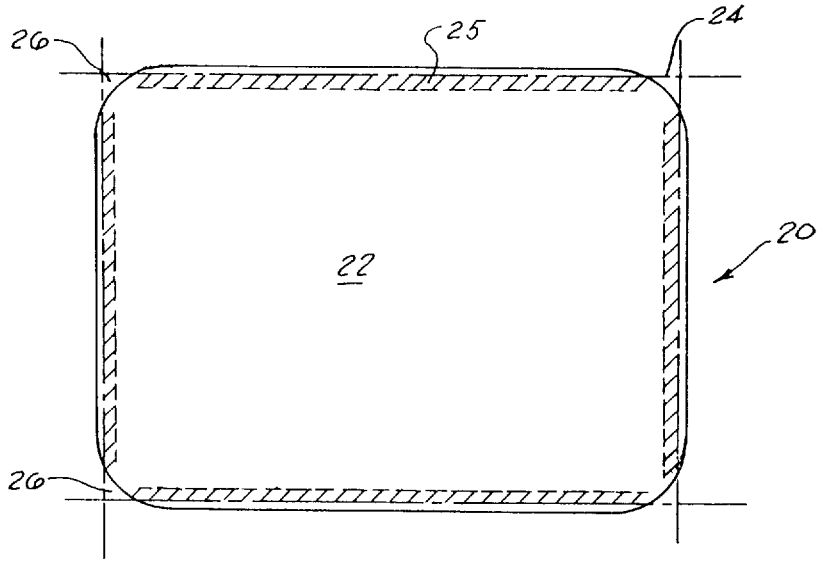
FIG. 4a (PRIOR ART)
FIG. 4 (FIGS. 4A and 4B) are schematic illustrations of a prior art lid/tray arrangement (FIG. 4A) and the lid/tray arrangement of the present invention (FIG. 4B).

Finally, FIG. 4 illustrates the novel aspects of the carton opening feature 14 which utilizes "straight line" sealing methods and tray 4 with flange 6 having a specified corner radius. In particular, as shown in FIG. 4A, a conventional carton 20 includes lid 22 which is sealed to flanges 24 of a conventional paperboard tray. It is important to note that sealing equipment used for heat sealing lids to trays, typically, yields a linear seal pattern 25. In sealing lid 22 to flanges 24 with a rounded corner, these systems are not compatible and, consequently, sealing voids 26 are created at the corners when the linear seal lines do not intersect.

Figure 4B:
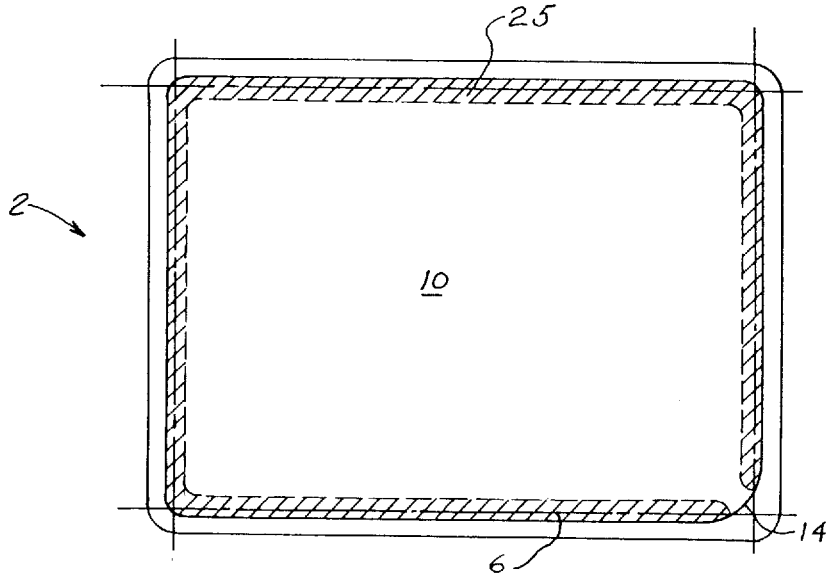

Conversely, as shown in FIG. 4B, the present invention employs a container 2 having a lid 10 that is constructed and heat sealed to extended flanges 6 of the paperboard tray such that the extended flanges 6 at the corners of tray 4 prevent substantial sealing voids. Also, the opening feature 14 creates an insignificant void which allows for a mechanical opening of the opening feature 14.

Once given the above disclosure, many other features, modifications or improvements will become apparent to the skilled artisan. Such features, modifications or improvements are, therefore, considered to be a part of this invention, the scope of which is to be determined by the following claims.

What is claimed is:

1. A container opening feature for a container, wherein said container is comprised of:

a polygonal shaped, flanged tray having first and second sides and a designated first corner having a first radius and a remainder of second corners of said tray have a second radius, wherein a heat sealable coating is located substantially adjacent to said first side of said tray, said flanges and said first and second corners; and a separate lid bonded to said tray flanges by said coating to close said container, wherein said lid has first and second sides and said lid has a designated third corner wherein said designated third corner has an opening feature and said designated third corner on said lid is located substantially over said designated first corner of said tray and extends a predetermined distance beyond said first corner.

2. The container opening feature for a container, as in claim 1, wherein said tray is further comprised of:

an extended flange.

3. The container opening feature for a container, as in claim 1, wherein said tray is further comprised of:

a pressed paperboard.

4. The container opening feature for a container, as in claim 1, wherein said tray is further comprised of:

a polymeric material.

5. The container opening feature for a container, as in claim 1, wherein said first side of said lid is further comprised of:

partial depth cut/score lines located substantially around a periphery of said first side of said lid to define a removable portion of said first side of said lid when said lid is removed from said tray; and said opening feature is located along said partial depth cut/score line and adjacent to said designated corner.

6. The container opening feature for a container, as in claim 1, wherein said tray flanges and lid are constructed such that said designated corner of said lid extends a first distance beyond said designated corner of said tray and other corners of said lid extend a second distance beyond other corners of said tray when said lid is placed over said tray flanges.

7. The container opening feature for a container, as in claim 1, wherein said corners of said lid have a substantially equal radius.

* * * * *